US005836126A

United States Patent [19]

Harkenrider et al.

[11] Patent Number: 5,836,126

[45] Date of Patent: Nov. 17, 1998

[54] MODULAR CONCRETE FORM SYSTEM AND METHOD FOR CONSTRUCTING CONCRETE WALLS

[75] Inventors: Thomas E. Harkenrider, Carlsbad; Scott D. Pinkerton, Bonita; Robert W. Buck, Lake Forest; Jeffrey L. Hanson, Chino, all of Calif.

[73] Assignee: The Salk Institute of Biological Studies, La Jolla, Calif.

[21] Appl. No.: 459,461

[22] PCT Filed: Nov. 22, 1994

[86] PCT No.: PCT/US94/13490

§ 371 Date: Nov. 24, 1995

§ 102(e) Date: Nov. 24, 1995

[87] PCT Pub. No.: WO95/14837

PCT Pub. Date: Jun. 1, 1995

Related U.S. Application Data

[63] Continuation-in-part of Ser. No. 156,271, Nov. 22, 1993, Pat. No. 5,537,797.

[51] Int. Cl.[6] ..... E04B 5/00

[52] U.S. Cl. ..... 52/410; 52/426; 249/40; 249/33; 249/216

[58] Field of Search ..... 52/410, 426, 434, 52/408, 309.13, 309.14; 249/33, 34, 40, 44, 45, 42, 191, 216

[56] References Cited

U.S. PATENT DOCUMENTS

| | | | |
|---|---|---|---|
| 2,314,866 | 3/1943 | Bosco | 25/131 |
| 3,690,613 | 9/1972 | Shoemaker | 249/40 |
| 3,938,776 | 2/1976 | Frazier | 249/114 |
| 3,965,635 | 6/1976 | Renkert | 52/434 |
| 4,037,816 | 7/1977 | Scott | 249/83 |
| 4,159,099 | 6/1979 | Maguire | 249/93 |
| 4,211,385 | 7/1980 | Johanson et al. | 249/192 |
| 4,397,441 | 8/1983 | Manderla | 249/19 |
| 4,426,061 | 1/1984 | Taggart | 52/410 X |
| 4,545,163 | 10/1985 | Asselin | 52/410 X |
| 5,311,717 | 5/1994 | Yount et al. | 52/417 |
| 5,323,578 | 6/1994 | Chagnon et al. | 52/426 |

FOREIGN PATENT DOCUMENTS

| | | | |
|---|---|---|---|
| 1909204 | 11/1969 | Austria | 37/36 |
| 519311 | 5/1953 | Belgium . | |
| 542144 | 11/1955 | Belgium . | |
| 918896 | 1/1973 | Canada | 25/159 |
| 73.19418 | 12/1974 | France | 4/17 |
| 1534857 | 6/1969 | Germany | 37/9 |
| 2163945 | 6/1971 | Germany | 28/7 |
| 2742883 | 4/1978 | Germany | 11/12 |
| 2730542 | 1/1979 | Germany | 4/17 |
| 2905944 | 8/1980 | Germany | 4/41 |

*Primary Examiner*—Lanna Mai
*Attorney, Agent, or Firm*—Baker & Maxham

[57] ABSTRACT

A system for forming architectural concrete walls comprises a plurality of modular form units (32), each form unit comprising a generally rectangular support frame, a backing sheet (34, 36) and an overlying facing sheet (56; 58), each facing sheet having a facing surface defined by a plastic material, an elastic seal (68) along an edge of the form unit for positioning between adjacent form units for preventing water leakage, a minimal number of tie holes (26) extending through each form unit, a seal tube (74) assembly for positioning between the tie holes, and a tie rod (80) for each tie hole. An architectural concrete wall having minimal tie holes and surface cavities and a highly polished marble-like surface is formed of a concrete mix including diatomaceous earth to impart a grey marble color and appearance.

19 Claims, 2 Drawing Sheets

MODULAR CONCRETE FORM SYSTEM AND METHOD FOR CONSTRUCTING CONCRETE WALLS

RELATED APPLICATION

This is a Continuation-In-Part Application of U.S. application Ser. No. 08/156,271 filed on Nov. 22, 1993, now U.S. Pat. No. 5,537,797.

TECHNICAL FIELD

The present invention relates to building construction and pertains particularly to improved architectural concrete walls and a forming system and method for forming architectural concrete walls.

BACKGROUND ART

Several methods and systems for constructing walls exist in the building industry. Each of the different wall systems has its own advantage for particular applications. Most modern high-rise buildings utilize a steel-girder frame with curtain wall covering. The underlying frame-work comprises welded steel girders. The covering is typically glass, stone or concrete panels secured to the girder construction.

Most low-rise buildings of no more than three stories employ a wood-frame with wood, stucco or other covering. The underlying framework is typically wooden beam and post construction. The covering of the building can be wood, stucco or some other suitable material.

Another type of construction employs concrete re-bar. In this type of construction, concrete is poured into forms and strengthened by reinforcing bars to form walls which also support the building. Columns for structural support and walls are formed around re-enforcing bars by means of concrete forms. The walls are poured in sections typically 10–14 feet in height. In its preferred form, the surface of the concrete walls provide the finished surface of the structure. This is known as architectural concrete construction.

One problem with architectural concrete construction is the difficulty and high cost associated with obtaining a satisfactory finished appearance. Present known techniques have difficulty in minimizing flaws that include, but are not limited to: 1) closely spaced tie holes, 2) water loss or leakage which results in discoloration, abrasion and sanding at the tie holes, 3) discoloration associated with form release agents, and 4) air pockets due to form release agents and leakage at formed panel joints.

Architectural concrete construction is desirable because it provides significant functional advantages for certain types of structures. Such advantages include utilizing the structural component of the building as the architectural finish skin, and eliminating the cost and complexity of additional systems, such as coverings and the like. A high quality architectural concrete can provide a highly durable, long lasting substantially zero maintenance system. It can also provide a pleasing appearance for a long period of time.

One example of world-renown architectural concrete construction is The Salk Institute in La Jolla, Calif. This building complex is often referred to as the standard for architectural concrete construction. Achieving even this standard is difficult with existing technology.

In the prior approach to forming architectural concrete walls, forms were typically made of sheets or panels of plywood attached to a framework of aluminum and/or wooden beams. The face of the plywood panels formed the surface texture of the concrete wall. Referring to FIG. 1, an exemplary wall section of the existing Salk Institute building structure is illustrated. In construction, the opposing faces of the forms were tied together by means of tie rods or snapties comprising bolts or rods extending through holes between the opposing form sections. These ties usually extended through the concrete and penetrated the form face. A sufficient number of tie rods or snapties were used to insure that the panels would be held in the proper spatial relationship and be prevented from bowing or buckling. As illustrated in FIG. 1, up to 12 or 14 tie rods were used for each panel of about 4×10 or 12 ft sections.

In the original construction, facing edges of the plywood sheets were beveled to provide a triangle or V-shaped ridge between each sheet member of a form panel section. This added to the pleasing appearance of the overall structure.

One significant disadvantage with this prior art construction was that chemical release agents used to inhibit concrete from sticking to the form panels contributed to discoloration of the wall structure. Such release agents also frequently resulted in air pockets which further impacted the final appearance of the wall. These disadvantages in addition to the necessity of employing closely spaced tie holes, added to the maintenance problem of the wall structure. The tie holes were scaled by means of lead discs.

The present architectural concrete forming system and methods were developed in order to improve upon the Salk Institute standard.

It is desirable that improved architectural wall structures and form systems and wall forming methods exist to provide higher quality, lower maintenance architectural concrete walls.

DISCLOSURE OF INVENTION

It is the primary object of the present invention to provide an improved wall form system for the construction of architectural concrete walls.

It is another object of the present invention to provide an improved method for producing high-quality, low-maintenance architectural concrete walls.

In accordance with a primary aspect of the present invention an improved architectural concrete wall and wall-forming system for constructing high quality architectural concrete walls includes a plurality of modular panel units. Each panel unit comprises a generally rectangular support frame, a backing sheet and an overlying facing sheet having a plastic facing surface thereon, a backing sheet and frame of multiple beams extending horizontally for supporting each panel, a plurality of vertical beams backing the horizontal beams and typically two tie rods for each 4'×8' sheet within the form panel unit.

BRIEF DESCRIPTION OF DRAWING

The objects, advantages and features of this invention will be more readily appreciated from the following detailed description, when read in conjunction with the accompanying drawing, in which.

BEST MODES FOR CARRYING OUT THE INVENTION

Figure 1:
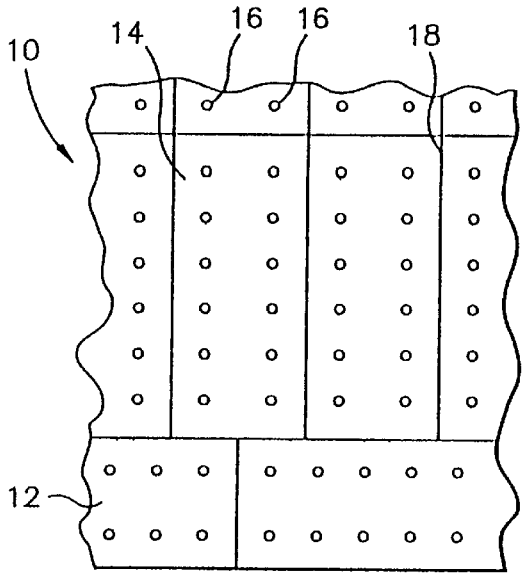
FIG. 1 (PRIOR ART)
FIG. 1 illustrates an elevational view of an architectural concrete wall in accordance with the prior art.
Figure 2:
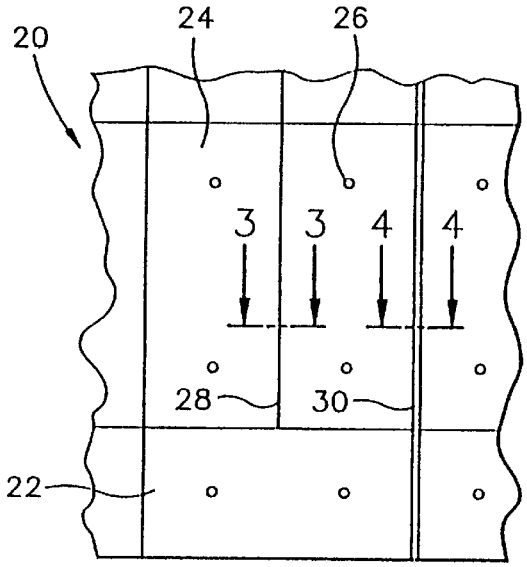
FIG. 2 is a view like FIG. 1 of an architectural concrete wall in accordance with the invention.
Figure 3:
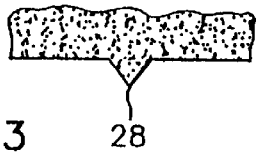
FIG. 3 is a view taken on line 3—3 of FIG. 2 showing a facing sheet to facing sheet joint within a form panel.

Referring to FIG. 2 of the drawings, a section of an improved concrete architectural wall is illustrated showing features in accordance with the present invention. The wall section is made up of concrete poured around re-enforcing bars within a form structure. The wall has a smooth highly finished polished marble like surface with minimal tie holes and surface cavities. The form structure retains the concrete in place until it sets up or hardens and also creates or forms the finished surface. The form structure in accordance with the present invention, provides a form panel made up of multiple sheets which, as illustrated in the embodiment, form horizontal sections 22 at a lower edge of a wall section and vertical sections 24 extending upward from the horizontal sections. The sheets are illustrated as being typically about 1.22×2.44 meters (4'×8'). These may also be about 1.22×3.05, 1.22×3.62, 1.22×4.15 meters (4'×10', 4'×12' or 4'×14'). Preferably a poured section of wall will form the structure between two floors.

A minimum number of tie bar holes 26 are provided in each panel of the present invention. In the illustrated embodiment only two ties holes are utilized for each sheet section of the form assembly. This provides two tie holes per 1.22×2.44 meter (4'×8') sheet. This means one tie hole per 1.44 square meter (16 square foot) section. A reduction in the tie bar holes is an advantage with respect to the final appearance and maintenance of the finished surface.

Figure 4:
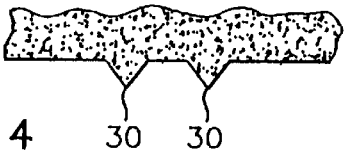
FIG. 4 is a view taken generally on line 4—4 of FIG. 2 showing a panel to panel joint.

The wall structure also has a sharp joint ridge 28 formed at the joint between adjacent facing sheets. This ridge is formed between the facing sheets of the form. In addition, a double ridge is formed at 30 between form panels. This double ridge is formed at the edge of a seal provided between form panels to reduce or preferably eliminate water leakage from the forms during the set-up of the concrete. This double ridge is shown and illustrated in FIG. 4.

Figure 5:
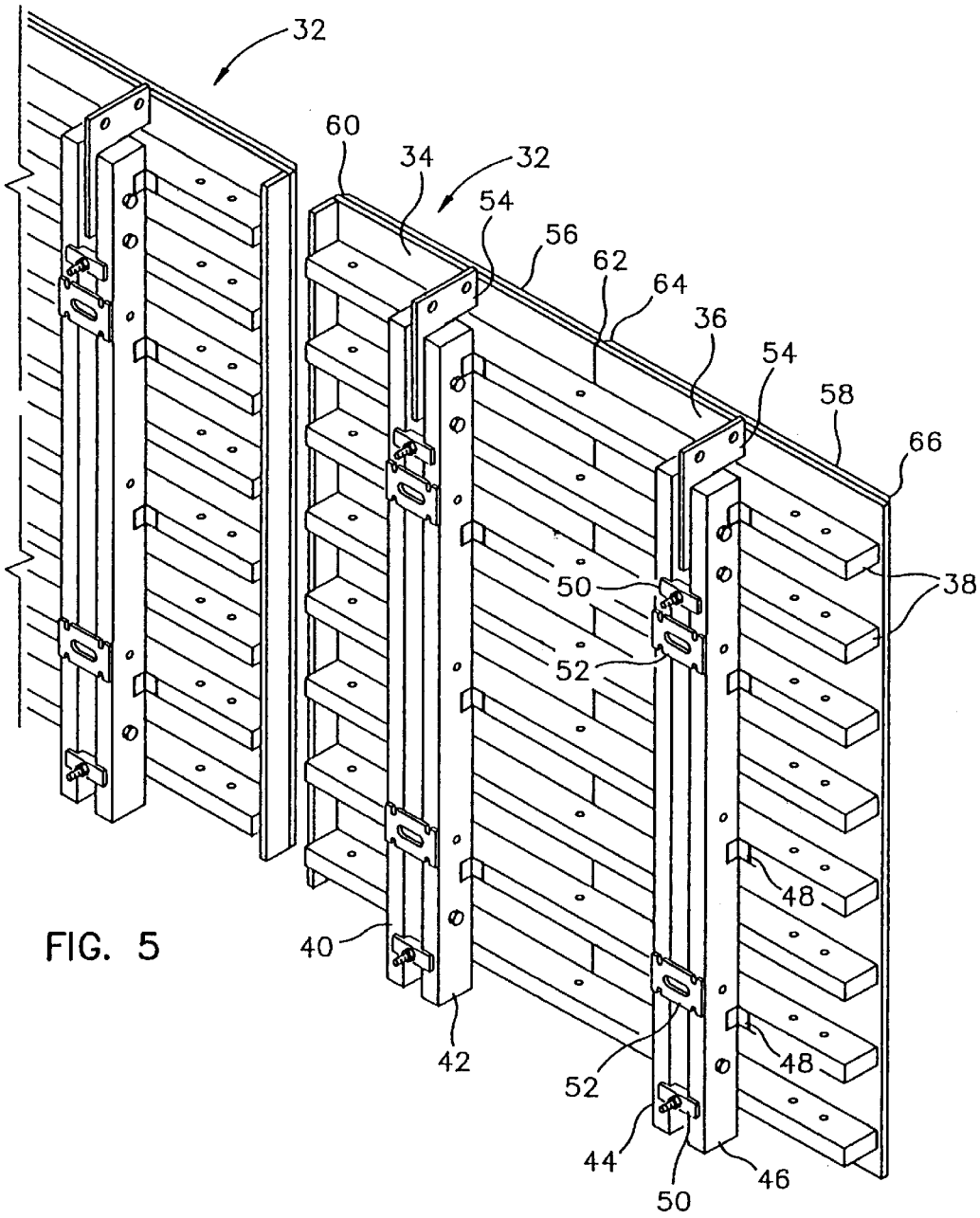
FIG. 5 is a perspective view of a typical modular form unit in accordance with the invention.

Referring now to FIG. 5, there are illustrated two identical form panel units, each designated generally by the numeral 32 and positioned end to end for connecting together to form an extended wall section. Only one of the form panel units will be described in detail. In the illustrated embodiment, form panel is made up of a plurality of backing sheets 34 and 36 secured to a framework of multiple horizontal base beams. Vertical beams and multiple horizontal beams 38 are selected to provide a rigid form structure and may be about 7.6×12.9 cm (3"×5") laminated wood members, aluminum beams, dimension lumber, or other suitable members. The horizontal beams are spaced close together, such that in the illustrated embodiment, eight beams are utilized to back up and support a panel structure which may be on the order of about ten feet in height. The backing sheets 34 and 36 are secured directly to the base beams.

The horizontal beams 38 are further backed up by closely spaced pairs of vertical beams 40, 42, 44, and 46. These vertical beams are positioned directly in the center of sheets 34 and 36 and are secured to each horizontal beam on alternating sides by angle brackets 48. The vertical and horizontal beams are also secured together by yoke brackets 50 with two brackets typically used on each vertical beam pair. The yoke brackets have a yoke member secured to the horizontal beam and a bolt extending to the bridge plate at the back of the beam pair which secures the units together.

A pair of tie plates 52 bridge the space between each pair of vertical beams and include a elongated hole or bore for receiving tie rods as will be further explained. Tie rods extend through holes in the form panel units and sleeves positioned between two spaced opposed form panel units for holding the units in spaced relation for receiving a pour of concrete. A pick-up bracket 54 is secured to the upper end of each of the vertical beam assemblies. This pickup bracket enables the form units to be picked up and manipulated by a suitable lift or crane.

Facing sheets 56 and 58 are attached respectively to the faces of backing sheets 34 and 36 from the back. Suitable fasteners such as screws extend through the backing sheets into the back of the facing sheets. This eliminates fasteners on the facing surface. The facing sheets comprise a laminate of plywood and plastic. Typically, a facing sheet comprises three quarter inch plywood having a plastic sheet forming the face thereof. The plastic face is a thin sheet of material such as polyethylene or the like and is on the order of about 1/10 inch in thickness. The plastic coating provides a smooth relatively non-stick surface for the concrete. It also eliminates the need for chemical form release agents.

The ends of each face sheet 56 is bevelled with bevels 60 and 62. Similarly, face sheet 58 is bevelled with bevelled edges 64 and 66. The bevel surfaces forming the groove between adjacent panels is also coated with polyurethane. The joint between the adjacent panels is sealed by means of a polyurethane concrete form sealer. A suitable sealer is manufactured by Nox-Crete, Inc.

Figure 6:
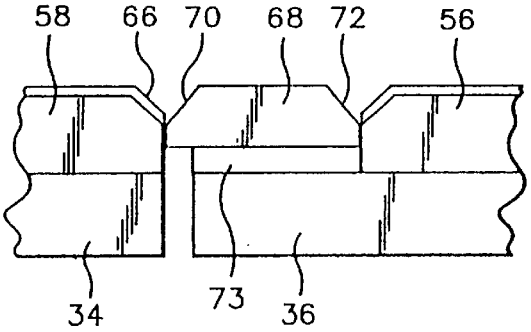
FIG. 6 is a partial detailed plan view showing details of seal structure between panels of FIG. 5.

Also, as illustrated in FIG. 6, one face sheet 56 is slightly shorter than the underlying sheet 36 to provide a space for the seal element 68 to be mounted as illustrated. The seal element 68 has beveled edges 70 and 72 which correspond to the bevel edges on the face sheets. The seal element which is fabricated from an elastomeric material and compressed between the abutting edges of the form panel units. The seal member is about ½ inch thick and mounted on a mounting strip 73 mounted on the backing sheet 36. This seal assembly seals the forms against loss of water from the concrete as it is setting up. This form system enhances the appearance and quality of the concrete wall structure.

Figure 7:
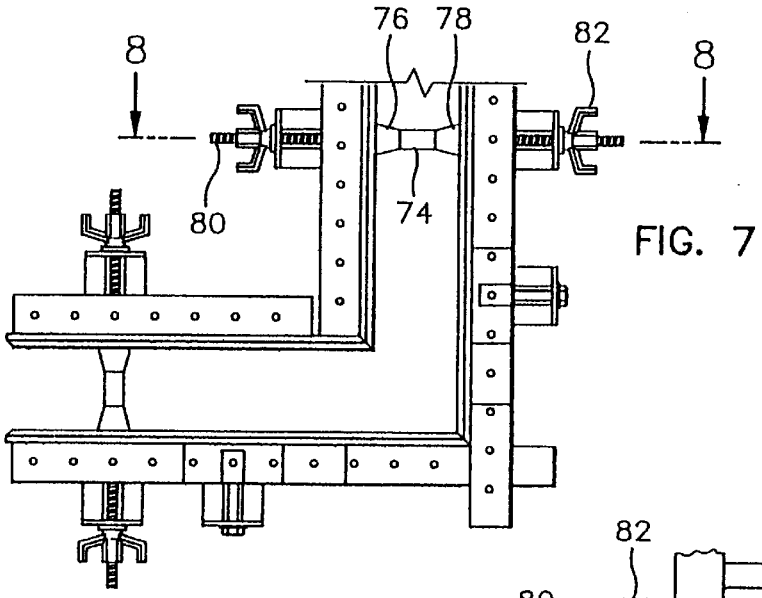
FIG. 7 is a top plan view illustrating opposed forms in a corner section.
Figure 8:
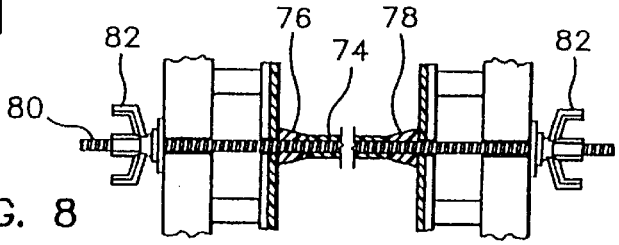
FIG. 8 is a partial detailed view taken generally on 8—8 of FIG. 7.

Referring now to FIG. 7, a top view of a section of form panel units set up for a wall structure including a corner is shown. As illustrated, the panels are held in spaced apart position by a space and tie assembly. The space and tie assembly includes a tubular sleeve 74 with a pair of cone-shaped elastomeric seal members 76 and 78 on each end of the tubular seal member. The sleeve 74 is preferably a section of PVC pipe. This assembly positions the form panel in a proper spatial relationship, providing a seal around the tie rod 80. The tie rod 80 is preferably formed of high tensile bar stock with nut members 82 on each end thereof. The bar structure has sufficiently high tensile strength to enable the overall form structure to be held together with a minimum number of tie bars. The tie bars can be constructed from post tensioning bar stock normally used for tensioning concrete panels or slabs. In a typical embodiment the nuts on the high tensile bar are torqued to 13.825 Kg-m (100 foot pounds). A torque of 13.825 Kg-m (100 foot pounds) has been found to effectively seal around the tie rods and prevent leakage of water from the form panel units.

When the form panel units are released, the seals 76 and 78 are easily removed and the sleeve 74 may be either removed or left in place, as desired. The tie holes are then sealed by means of disc-shaped lead plugs, or the like. The structure as illustrated, provides a clean highly-finished tie hole, which resists corrosion and weather damage. The facing sheets in accordance with the subject structure, together with pre-determined concrete mix, produces a concrete wall having an appearance of polished marble. We have obtained excellent results with this system obtaining walls of a highly polished and marble like appearance. The combination of form panel units and concrete mix has produced a highly attractive wall structure. The wall structure was given a slightly gray color by adding a quantity of pozalan, having a gray color to the concrete mixture. The pozalan is a diatomaceous earth material which is normally white in color and widely used in filters in the beer industry and in swimming pool filters. It has also been used in concrete to increase hydration so that less water is needed.

The mix proportions of a preferred concrete mixture employed in the present invention are set forth below:

CONCRETE MIX PROPORTIONS

| MATERIAL | AGGRE-GATE SIZE | PER-CENTAGE | WEIGHT (lbs.) | ABSOLUTE VOLUME |
|---|---|---|---|---|
| Coarse Aggregate | ½" | 44% | 1,199 | 7.33 |
| Coarse Aggregate | ⅜" | 11% | 299 | 1.83 |
| Sand | | 45% | 1,254 | 7.60 |
| Water | | 47.3 gal | 395 | 6.99 |
| Cement (ASTM C-150, Type III) | | 6.45 sacks | 606 | 3.05 |
| Flyash (ASTM C-618, Class F) | | | 67 | .49 |
| Grafco Dicalite | | | 60 | .43 |
| | | TOTAL | 3,880 | 27.0 |

A higher strength is imparted to the concrete by the addition of Masters Builders synthetic Pozalon 300R at 5 oz./cwt total cement. Pozalon is a commercially produced liquid chemical hydration agent that reduces the amount of water needed for a given quantity of cement. The Grafco Dicalite is diatomaceous earth that is a natural pozalon mined at Lompoc, California. It was selected to impart the desirable gray marble coloring to the concrete.

When an architectural concrete wall structure is to be built, according to the present invention, appropriate size form panel units are determined. The formation of architectural concrete walls is carried out by selecting or constructing a plurality of modular form panel units, each form comprising a generally rectangular support frame, backing sheet and overlying facing sheet having a plastic facing. The form panel units are provided having a backing frame of multiple beams extending across and supporting each sheet. A plurality of the form panel units are positioned in opposed facing relationship for forming a predetermined section of wall. Elastic seal means are provided between adjacent modular panel units for preventing water leakage. Typically, a plurality of two tie holes and tie assemblies are provided for each thirty-two square feet of panel area. Each tie assembly comprises a seal tube assembly for positioning between a pair of opposed panels aligned with the tie holes. The opposed facing form panel units are tied together by means of a tie rod assembly positioned in each tie hole. With appropriate reinforcing bars in place, a pre-selected mix of concrete is then poured into the space between the forms and allowed to cure. Vibrators are used inside the forms during pouring of the concrete to consolidate the concrete and reduce or eliminate air pockets and voids. The concrete is preferably poured in about three steps or stages for each wall section. The vibrator is dipped in and run from about 5 seconds to about 10 seconds as it drops to the bottom of the pour and as it is brought back out. It may be run up to 30 seconds to make sure the air has been forced out of the concrete.

The facing sheets are a laminate plywood sheet and a smooth, non-adhering, non-image transferring sheet of a plastic material. The plastic sheet has a thickness of about one tenth of an inch. Suitable plastics that may be employed include polyethylene and the like. The facing sheets are constructed so as to have bevel around the face thereof. The backing sheet and the facing sheet are each selected to be about three-quarters of an inch thick. This provides a stiff structure and reduces unwanted curvature in the wall. The form panel units are each formed or provided with about two tie holes for receiving tie bar assemblies. Tie rods for the tie assemblies are formed of high tensile rod stock. The tie rods and seal tubes are installed to hold the panels in spaced relation and torqued tensioned to 100 foot pounds of torque. The present invention provides a system and method for economically constructing attractive low maintenance wall structures having a smooth polished marble like surface. One economic advantage of the invention is that the form units may be reused a number of times.

While we have illustrated and described our invention by means of specific embodiments, it is to be understood that numerous changes and modifications may be made without departing from the spirit or scope of the invention as defined in the appending claims.

We claim:

1. A modular form unit for architectural concrete walls, comprising:

a generally rectangular support frame of multiple parallel base beams normally disposed horizontally;

a pair of closely spaced backing beams normally disposed vertically and secured to a back of said base beams;

a backing sheet secured to a front of said base beams;

a facing sheet overlying and secured to said backing sheet, said facing sheet is a laminate of plywood and a plastic sheet, the plastic sheet having a thickness of about one tenth of an inch;

a plurality of tie holes extending through said facing sheet;

a seal tube assembly for positioning between a pair of opposed form units aligned with opposing tie holes; and a high tensile tie rod for each tie hole.

2. A form unit according to claim 1 wherein said plastic is polyethylene.

3. A form unit according to claim 1 wherein said backing sheet (34, 36) and said facing sheet (56, 58) are each about 1.9 cm (¾ inch) thick.

4. A form unit according to claim 3 wherein said tie rods are formed of high tensile rod stock.

5. A form unit according to claim 4 wherein said tie rods (80) are capable of being torqued to 13.825 Kg-m (100 foot pounds) of torque.

6. A form unit according to claim 1 wherein said tie rods (80) are formed of high tensile rod stock and are capable of being torqued to 13.825 Kg-m (100 foot pounds) of torque.

7. A form system according to claim 1 wherein said plurality of tie holes for tie rods are no more than about two for each facing sheet.

8. A form unit for architectural concrete walls, comprising:

a generally rectangular support frame of multiple parallel base beams normally disposed horizontally;

a pair of closely spaced backing beams normally disposed vertically and secured to a back of said base beams;

a backing sheet secured to a front of said base beams;

a facing sheet overlying and secured to said backing sheet, said facing sheet is a laminate of plywood and a polyethylene plastic sheet, the plastic defining a facing surface having a thickness of about one tenth of an inch;

a plurality of tie holes extending through said facing sheet;

a seal tube assembly for positioning between a pair of opposed form units aligned with opposing tie holes; and a high tensile tie rod for each tie hole wherein said facing sheet is beveled around the face thereof.

9. A form unit according to claim 8 wherein said backing sheet and said facing sheet are each about three-quarters of an inch thick.

10. A form system of modular form units for forming architectural concrete walls, the form system comprising:

a generally rectangular support frame of multiple parallel base beams normally disposed horizontally;

a plurality of closely spaced pairs of backing beams normally disposed vertically and secured to a back of said base beams;

a plurality of backing sheets secured to a front of said base beams;

a plurality of facing sheets overlying and secured to said backing sheets, each facing sheet is a laminate of plywood and a plastic sheet, and having a facing surface defined by said plastic sheet, the plastic sheet having a thickness of about one tenth of an inch;

an elastic seal member mounted along a side edge of each modular form unit, the seal member being supported on the backing sheet and disposed at the edge of the facing sheet for sealing between adjacent modular form units for preventing water leakage;

a plurality of tie holes for each facing sheet positioned between the beams of each of said pairs of backing beams;

a high tensile tie rod for extending between each aligned pair of tie holes; and a seal tube assembly comprising an elongated tube and a pair of elastomeric cones for each end of the tube for positioning between a pair of aligned tie holes for sealing the tie rod.

11. A form system according to claim 10 wherein said facing sheets and said backing sheets are each about three quarters of an inch thick.

12. A form system according to claim 11 wherein said plastic sheet is a sheet of polyethylene.

13. A form system according to claim 12 wherein said tie rods are formed of high tensile rod stock.

14. A form system according to claim 10 wherein said plastic sheet is polyethylene.

15. A form system according to claim 14 wherein each of said backing sheets and each of said facing sheets are each about three-quarters of an inch thick.

16. A form system according to claim 15 wherein said tie rods are formed of high tensile rod stock.

17. A form system according to claim 16 wherein said tie rods are torqued to about 100 foot pounds of torque.

18. A form system according to claim 10 wherein said plurality of tie holes for tie rods are no more than about two for each facing sheet.

19. A form system of modular form units for forming architectural concrete walls, the form system comprising:

a generally rectangular support frame of multiple parallel base beams normally disposed horizontally;

a plurality of closely spaced pairs of backing beams normally disposed vertically and secured to a back of said base beams;

a plurality of backing sheets secured to a front of said base beams;

a plurality of facing sheets overlying and secured to said backing sheets, each facing sheet is a laminate of plywood and a plastic sheet having a facing surface, the plastic sheet having a thickness of about one tenth of an inch;

an elastic seal member mounted along a side edge of each modular form unit, the seal member being supported on the backing sheet and disposed at the edge of the facing sheet for sealing between adjacent modular form units for preventing water leakage;

a plurality of tie holes for each facing sheet positioned between the beams of each of said pairs of backing beams;

a high tensile tie rod for extending between each aligned pair of tie holes; and a seal tube assembly comprising an elongated tube and a pair of elastomeric cones for each end of the tube for positioning between a pair of aligned tie holes for sealing the tie rod, wherein each of said facing sheet has a bevel around the face thereof.

* * * * *